US006969241B2

(12) United States Patent
Hayashi et al.

(10) Patent No.: US 6,969,241 B2
(45) Date of Patent: Nov. 29, 2005

(54) VIBRATION DAMPING MECHANISM FOR PISTON TYPE COMPRESSOR

(75) Inventors: Shiro Hayashi, Kariya (JP); Hideki Mizutani, Kariya (JP); Atsuyuki Morishita, Kariya (JP); Hiroaki Kayukawa, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/768,213

(22) Filed: Jan. 30, 2004

(65) Prior Publication Data

US 2004/0184924 A1 Sep. 23, 2004

Related U.S. Application Data

(62) Division of application No. 10/196,896, filed on Jul. 16, 2002, now abandoned.

(30) Foreign Application Priority Data

Jul. 31, 2001 (JP) ..... 2001-231202

(51) Int. Cl.[7] ..... F01B 1/12; F04B 3/00

(52) U.S. Cl. ..... 417/269; 92/71

(58) Field of Search ..... 417/269; 91/499; 92/71, 84; 60/469

(56) References Cited

U.S. PATENT DOCUMENTS 4,789,311 A 12/1988 Ikeda et al.
5,768,974 A * 6/1998 Ikeda et al. ..... 92/71

FOREIGN PATENT DOCUMENTS

| | | |
|---|---|---|
| EP | 0649914 | 4/1995 |
| EP | 1046817 | 10/2000 |
| JP | 2000018156 | 1/2000 |

* cited by examiner

*Primary Examiner*—Charles G. Freay
(74) *Attorney, Agent, or Firm*—Knoble Yoshida & Dunleavy LLC

(57) ABSTRACT

A piston type compressor includes a housing forming a cylinder bore. A drive shaft is supported by the housing. A cam plate is coupled to the drive shaft and is rotated by the rotation of the drive shaft. A piston is accommodated in the cylinder bore and is coupled to the cam plate. The rotation of the cam plate is converted into the reciprocating movement of the piston. In accordance with the reciprocating movement of the piston, gas is introduced into the cylinder bore, is compressed and is discharged from the cylinder bore. Compression reactive force is generated in compressing the gas by the piston, is transmitted to the housing through a compression reactive force transmission path and is received by the housing. A vibration damping member is made of a predetermined vibration damping alloy and is placed at least one location along the compression reactive force transmission path.

15 Claims, 7 Drawing Sheets

VIBRATION DAMPING MECHANISM FOR PISTON TYPE COMPRESSOR

This is a divisional of prior application Ser. No. 10/196,896, filed in Jul. 16, 2002 under 37 CFR 1.53(b), now abandoned.

BACKGROUND OF THE INVENTION

The present invention relates to vibration damping mechanism for a piston type compressor.

As disclosed in Japanese Unexamined Patent Publication No. 2000-18156, compression reactive force is generated in a piston type compressor in compressing gas by a piston and causes the piston type compressor to vibrate. Namely, the front housing vibrates since the compression reactive force is transmitted to a front housing through a swash plate, a hinge mechanism, a lug plate and a thrust bearing.

In Japanese Unexamined Patent Publication No. 2000-18156, in order to reduce the vibration of the compressor, a vibration damping steel sheet is placed between the front housing and the thrust bearing or between the lug plate and the thrust bearing.

The vibration damping steel sheet is constituted of a pair of steel pieces and rubber bonded between the pair of steels with glue. The adhesion of the glue deteriorates due to a relatively high temperature in the compressor whose maximum temperature is 200° C. Therefore, it is hard to maintain enough adhesive strength of the glue. That is, it is hard to keep the durability of the vibration damping steel sheet. Also, since the vibration absorption performance of rubber or resin depends on temperature and the temperature in the compressor varies, it is hard to maintain the vibration absorption performance of an elastic member that is made of rubber and resin for absorbing a target frequency of the vibration. Furthermore, since the vibration damping steel sheet is bent to correspond with the shape of the inner wall of the front housing, the vibration absorption performance of the vibration damping steel sheet varies depending on the region of the sheet. Therefore, bending the vibration damping steel is not generally desired. That is, the degree of the freedom in the shape of the vibration damping steel sheet is relatively small.

As described above, because of the relatively large load applied to the elastic member and the relatively high temperature up to 200° C. in the compressor, it is hard to maintain the durability of the elastic member made of rubber or resin.

SUMMARY OF THE INVENTION

In order to solve the above and other problems, according to a first aspect of the current invention, a piston type compressor including a housing including a cylinder bore, a drive shaft supported by the housing, a lug plate secured to the drive shaft, the lug plate being rotationally supported by the housing, a cam plate coupled to the lug plate, the cam plate being rotated by the rotation of the drive shaft, a piston accommodated in the cylinder bore, the piston being coupled to the cam plate, the rotation of the cam plate being converted into the reciprocating movement of the piston, in accordance with the reciprocating movement of the piston, gas being introduced into the cylinder bore, the gas being compressed and discharged from the cylinder bore, compression reactive force being generated while the gas is being compressed by the piston, the compression reactive force being transmitted from the piston to the housing through a compression reactive force transmission path, the compression reactive force transmission path further including the drive shaft and the lug plate between the piston and the housing, and a vibration damping member made of a predetermined vibration damping alloy, the vibration member being placed between the lug plate and the drive shaft.

According to the second aspect of the current invention, a variable displacement compressor including a housing including a plurality of cylinder bores, a drive shaft supported by the housing, a lug plate secured to the drive shaft, the lug plate being supported in the housing by a thrust bearing, a cam plate coupled to the lug plate by a hinge mechanism that includes a guide hole and a guide ball, the cam platebeing slidably supported by the drive shaft and being at a certain angle within a predetermined range with respect to the drive shaft, the cam plate being rotated by the rotation of the drive shaft, a plurality of pistons accommodated in the cylinder bores, each piston being coupled to the cam plate, the rotation of the cam plate being converted into the reciprocating movement of the pistons, in accordance with the reciprocating movement of the pistons, gas being introduced into the cylinder bores and being compressed and being discharged from the cylinder bores, compression reactive force being generated while the gas is being compressed by the pistons and being transmitted from the piston to the housing through a compression reactive force transmission path that includes a set of members including the pistons, the cam plate, the hinge mechanism, the lug plate, the drive shaft, the thrust bearing and the housing, the compression reactive force being received by the housing, and a vibration damping member made of a predetermined vibration damping alloy, the vibration damping alloy being placed between the lug plate and the drive shaft.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
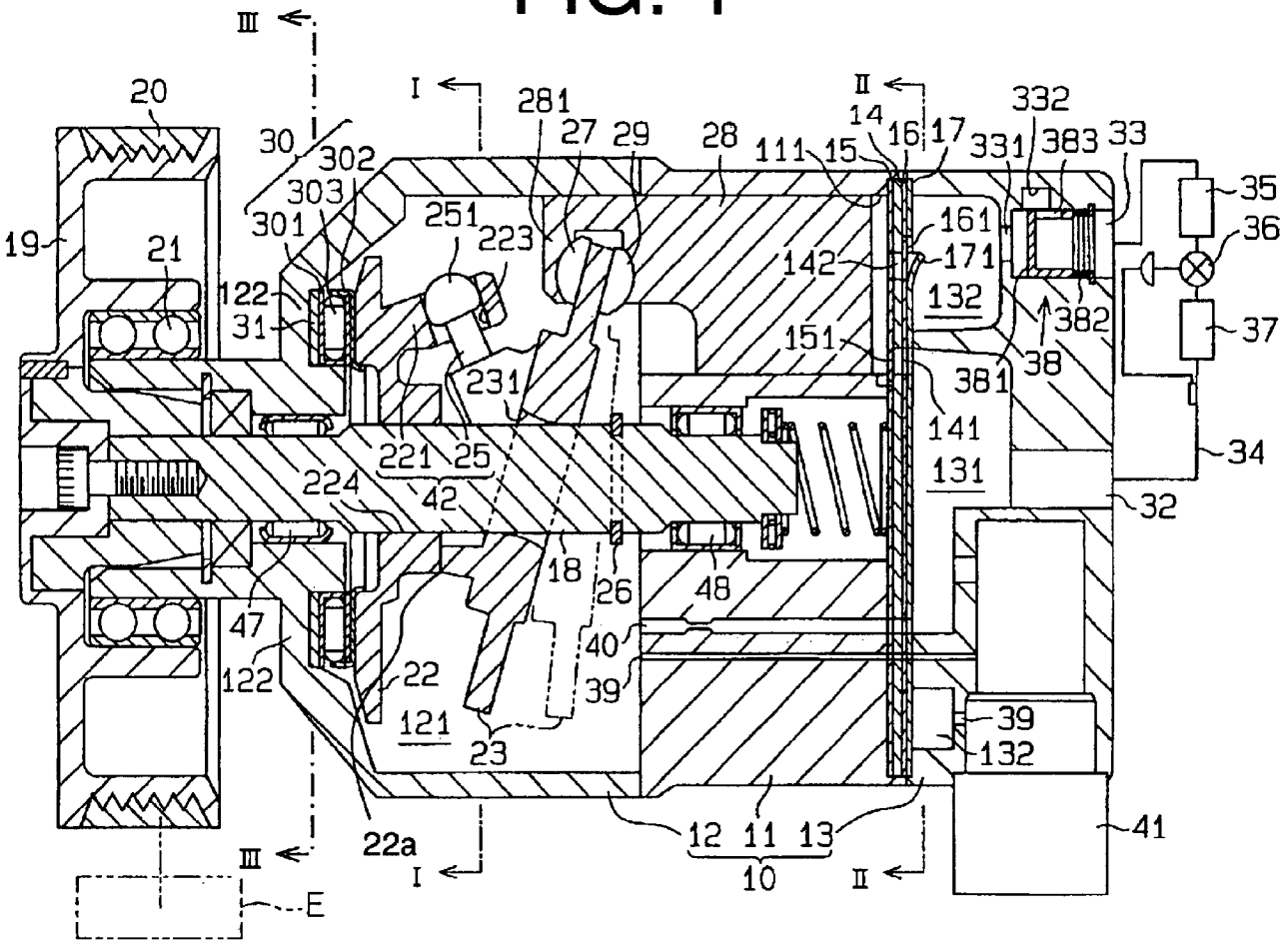
FIG. 1 is a longitudinal cross-sectional view of a variable displacement compressor of a first preferred embodiment according to the present invention.

In a first preferred embodiment, the present invention is applied to a variable displacement compressor as illustrated in FIGS. 1 through 5. In FIG. 1, the left side and the right side of the drawing respectively correspond to the front side and the rear side of the variable displacement compressor. A front housing 12 is secured to the front end of a cylinder block 11. A rear housing 13 is fixedly secured to the rear end of the cylinder block 11. A valve plate 14, a suction valve plate 15, a discharge valve plate 16 and a retainer plate 17 are placed between the cylinder block 11 and the rear housing 13. A housing 10 of the variable displacement compressor includes the front housing 12, the cylinder block 11 and the rear housing 13.

The front housing 12 and the cylinder block 11 define a crank chamber 121. In the crank chamber 121, a drive shaft 18 is rotatably supported in the front housing 12 and the cylinder block 11 by radial bearings 47 and 48. The drive shaft 18 projects from the front end of the front housing 12, and a pulley 19 is secured to the front end of the drive shaft 18. The pulley 19 is coupled to an engine E as an external drive source by a belt 20. The pulley 19 is supported at an end of the front housing 12 by an angular bearing 21. The front housing 12 receives the thrust and radial loads applied to the pulley 19 through the angular bearing 21.

A lug plate 22 is secured to the drive shaft 18. A swash plate 23 is slidably supported by the drive shaft 18 in the crank chamber 121 and is tiltable with respect to the axis of the drive shaft 18. The drive shaft 18 is inserted through a shaft hole 224 of the lug plate 22 and a shaft hole 231 of the swash plate 23.

Figure 2:
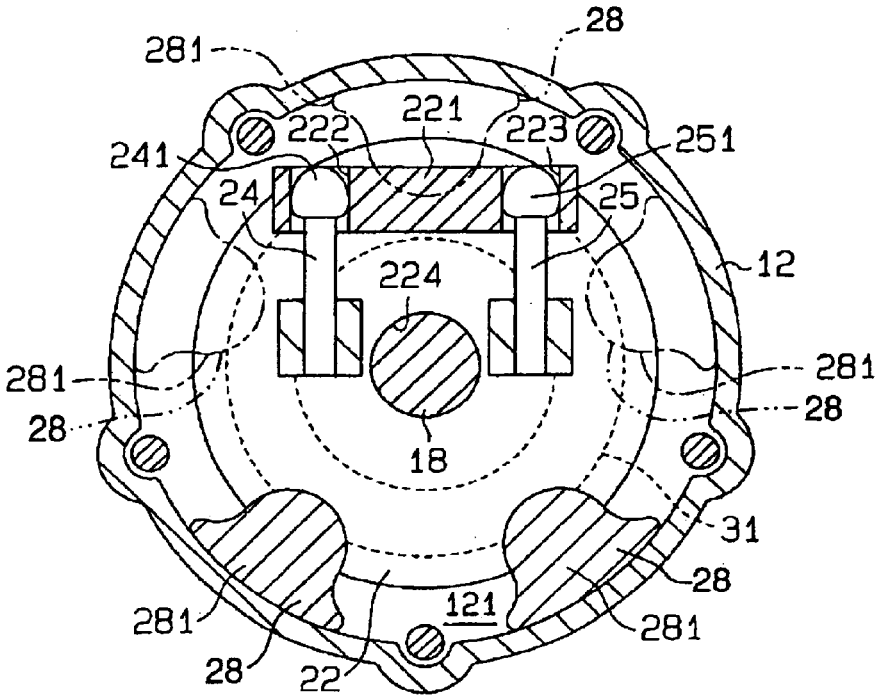
FIG. 2 is a cross-sectional view of the variable displacement compressor taken along the line I—I in FIG.1.

As also shown in FIG. 2, a pair of guide pins 24, 25 extends from the swash plate 23. The reference numerals refer to a substantially identical element bearing the same number in FIG. 1, and the corresponding description is not reiterated. A pair of guide balls 241 and 251 is respectively provided at the distal end of the guide pins 24, 25. A support arm 221 extends from the lug plate 22 so as to protrude therefrom and has a pair of guide holes 222, 223. The guide balls 241, 251 are slidably inserted respectively into the guide holes 222, 223.

Still referring to FIGS. 1 and 2, the cooperation of the guide holes 222, 223 and the pair of guide pins 24, 25 allows the swash plate 23 to tilt with respect to the axis of the drive shaft 18 and to rotate integrally with the drive shaft 18. The inclination of the swash plate 23 is guided by the slidable movement of the guide balls 241, 251 in the corresponding guide holes 222, 223. The swash plate 23 is thus slidably supported by the drive shaft 18. A hinge mechanism 42 includes the support arm 221 having the guide holes 222, 223, and the guide pins 24, 25 having the corresponding guide balls 241, 251. The swash plate 23 is coupled to the lug plate 22 by the hinge mechanism 42.

Referring back to FIG. 1, the maximum inclination angle of the swash plate 23 is restricted by the contact of the swash plate 23 against the lug plate 22 at a point 22*a*. The position of the swash plate 23 indicated by a solid line in FIG. 1 is at the maximal inclination angle of the swash plate 23. The minimum inclination angle of the swash plate 23 is restricted by the contact of the swash plate 23 against a circlip 26, which is fitted on the drive shaft 18. The position of the swash plate 23 indicated by a chain line in FIG. 1 is at the minimal inclination angle of the swash plate 23.

Figure 3:
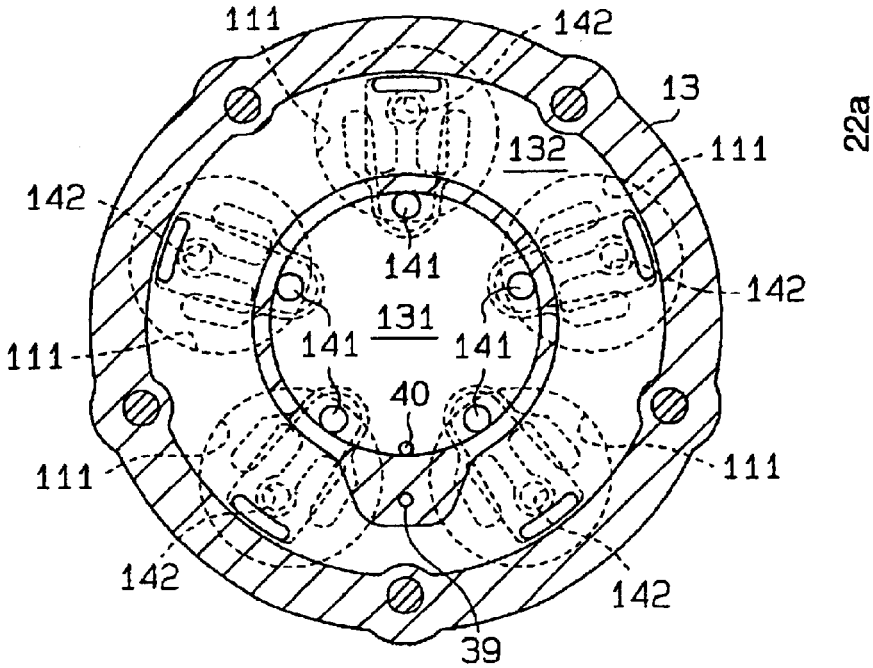
FIG. 3 is a cross-sectional view of the variable displacement compressor taken along the line II—II in FIG. 1.

A plurality of cylinder bores 111 is formed in the cylinder block 11. In fact, five cylinder bores 111 exist in the embodiment as shown in FIG. 3, which is a cross sectional view at II—II of FIG. 1. The reference numerals refer to a substantially identical element bearing the same number in FIG. 1, and the corresponding description is not reiterated. A piston 28 is accommodated in each cylinder bore 111 arranged around the drive shaft 18 in the cylinder block 11. As shown in FIG. 1, a pair of shoes 27, 29 are interposed between a neck portion 281 of each piston 28 and the swash plate 23. The rotating movement of the swash plate 23, which rotates integrally with the drive shaft 18, is converted to a reciprocating movement of each piston 28. Each piston 28 reciprocates in the corresponding cylinder bore 111.

A suction chamber 131 and a discharge chamber 132 are formed in the rear housing 13. As each piston 28 moves from the top dead center to the bottom dead center in the corresponding cylinder bore 111, refrigerant gas in the suction chamber 131 is drawn into the cylinder bore 111 through an associated suction port 141 in the valve plate 14 and an associated suction valve 151 in the suction valve plate 15. As each piston 28 moves from the bottom dead center to the top dead center in the corresponding cylinder bore 111, the refrigerant gas in the cylinder bore 111 is compressed and is discharged to the discharge chamber 132 through an associated discharge port 142 in the valve plate 14 and an associated discharge valve 161 in the discharge valve plate 16. The opening of each discharge valve 161 is restricted by the contact of the discharge valve 161 against a corresponding retainer 171 formed on the retainer plate 17.

Figure 4:
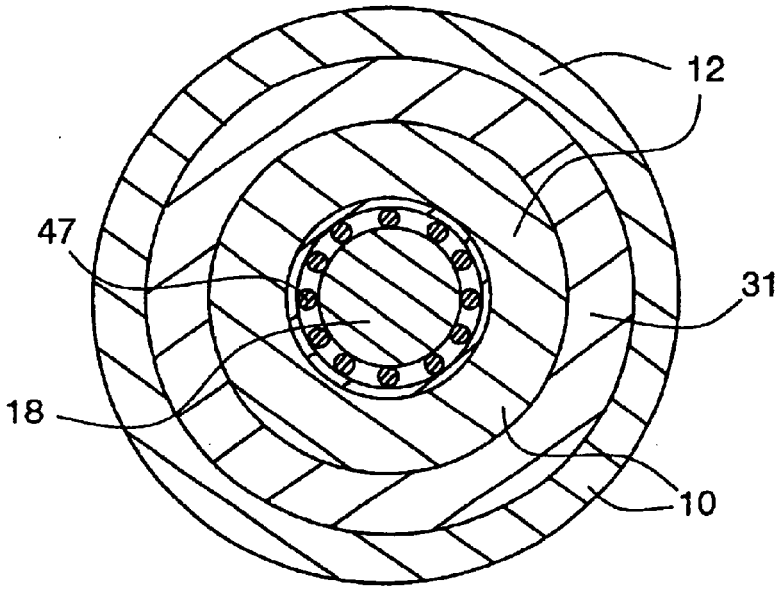
FIG. 4 is a cross-sectional view of the variable displacement compressor taken along the line III—III in FIG. 1.
Figure 5:
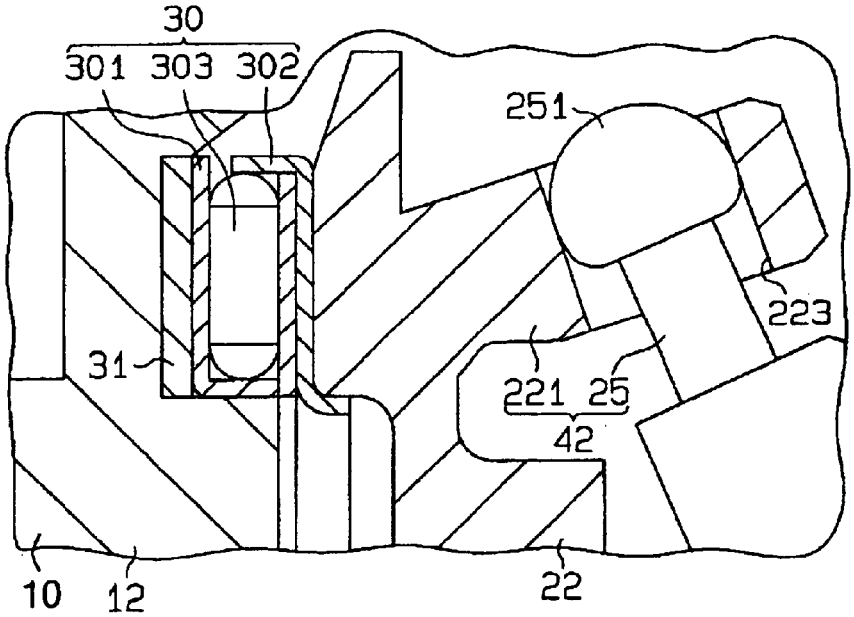
FIG. 5 is a partially enlarged cross-sectional view of the variable displacement compressor of the first preferred embodiment according to the present invention.

A thrust bearing 30 is interposed between the front end wall 122 of the front housing 12 and the lug plate 22. The thrust bearing 30 includes a pair of bearing races 301, 302 and rollers 303 interposed between the pair of bearing races 301, 302. As shown in FIGS. 4 and 5, a ring-shaped vibration damping sheet 31 is made of vibration damping alloy and is interposed between the bearing race 301 of the thrust bearing 30 and the front end wall 122 of the front housing 12. The reference numerals in FIGS. 4 and 5 refer to a substantially identical element bearing the same number in FIG. 1, and the corresponding description is not reiterated. In the first preferred embodiment, the vibration damping alloy material is Fe—Cr—Al that is one of exemplary vibration damping alloy of ferromagnetic type. As shown in FIG. 5, the vibration damping sheet 31 is bonded to the front end wall 122 and the bearing race 301 of the thrust bearing 30.

Compression reactive force is generated in compressing the gas by the pistons 28. The compression reactive force is received by the front end wall 122 of the front housing 12 from the pistons 28 via the shoes 29, the swash plate 23, the hinge mechanism 42, the lug plate 22 and the thrust bearing 30 to the vibration damping sheet 31. A compression reactive force transmission path includes the front housing 12, the pistons 28, the shoes 29, the swash plate 23, the hinge mechanism 42, the lug plate 22, the thrust bearing 30 and the vibration damping sheet 31.

An inlet 32 for introducing the refrigerant gas to the suction chamber 131 is connected to an outlet 33 for discharging the refrigerant gas from the discharge chamber 132 via an external refrigerant circuit 34. The external refrigerant circuit 34 includes a condenser 35, an expansion valve 36 and an evaporator 37. A check valve 38 is interposed in the outlet 33.

A valve body 381 of the check valve 38 is urged by a spring 382 in a direction to shut a valve hole 331. When the body valve 381 is open at the position as shown in FIG.1, the refrigerant gas outflows from the discharge chamber 132 to the external circuit 34 via the valve hole 331, a detour 332, an opening 383 formed in the valve body 381, and the inside of the valve body 381. When the valve body 381 shuts the valve hole 331, the refrigerant gas in the discharge chamber 132 does not outflow to the external circuit 34.

The discharge chamber 132 is connected to the crank chamber 121 via a supply passage 39. The refrigerant gas in the discharge chamber 132 flows to the crank chamber 121 via the supply passage 39. The crank chamber 121 is connected to the suction chamber 131 via a bleed passage 40. The refrigerant gas in the crank chamber 121 flows to the suction chamber 131 via the bleed passage 40. An electromagnetic displacement control valve 41 is interposed in the supply passage 39. Thus, the displacement control valve 41 controls suction pressure to be a target suction pressure in accordance with the valve of an electric current supplied to the displacement control valve 41.

As the value of the electric current supplied to the displacement control valve 41 increases, the opening degree of the displacement control valve decreases and the amount of refrigerant gas that is supplied from the discharge chamber 132 to the crank chamber 121 also decreases. Since the refrigerant gas in the crank chamber 121 outflows to the suction chamber 131 through the bleed passage 40, the pressure in the crank chamber 121 falls. Therefore, the inclination angle of the swash plate 23 increases, and the amount of discharged refrigerant gas from the compressor also increases. The increase in the amount of discharged refrigerant gas from the compressor causes the suction pressure to decrease. On the other hand, as the value of the electric current supplied to the displacement control valve 41 decreases, the opening degree of the displacement control valve 41 increases and the amount of refrigerant gas that is supplied from the discharge chamber 132 to the crank chamber 121 increases. Then, the pressure in the crank chamber 121 increases, and the inclination angle of the swash plate 23 decreases. Therefore, the discharge amount decreases. The decrease in the amount of discharged refrigerant gas from the compressor causes the suction pressure to increase.

When the value of the electric current supplied to the displacement control valve 41 becomes zero, the opening degree of the displacement control valve 41 reaches the maximum, and the inclination angle of the swash plate 23 becomes the minimum. The discharge pressure is relatively low at this time. The spring constant of the spring 382 is determined in a such manner that the force resulting from the pressure upstream to the check valve 38 in the outlet 33 is less than the sum of the force resulting from the pressure downstream to the check valve 38 and the force of the spring 382. Therefore, when the inclination angle of the swash plate 23 becomes the minimum, the valve body 381 shuts the valve hole 331 and the circulation of the refrigerant gas into the external refrigerant circuit 34 stops. When the circulation of the refrigerant gas stops, the reduction in thermal load is also stopped.

The minimum inclination angle of the swash plate 23 is slightly larger than zero degree. Therefore, even when the inclination angle of the swash plate 23 is at the minimum, the refrigerant gas is still discharged from each cylinder bore 111 to the discharge chamber 132 at a certain level. The refrigerant gas flows from the discharge chamber 132 into the crank chamber 121 via the supply passage 39. Then the refrigerant gas flows from the crank chamber 121 to the suction chamber 131 via the bleed passage 40. The refrigerant gas in the suction chamber 131 is introduced into each cylinder bore 111 and is compressed to be discharged into the discharge chamber 132. Namely, when the inclination angle of the swash plate 23 is at the minimum, the refrigerant gas circulates through the discharge chamber 132, the supply passage 39, the crank chamber 121, the bleed passage 40 and each cylinder bore 111 in the compressor. The pressure in the discharge chamber 132, the crank chamber 121 and the suction chamber 131 is different from each other. Therefore, the refrigerant gas circulates through the discharge chamber 132, the supply passage 39, the crank chamber 121, the bleed passage 40 and each cylinder bore 111 in the compressor under a different pressure, and the inside of the compressor is lubricated by lubricating oil contained in the refrigerant gas.

According to the first preferred embodiment, following advantageous effects are obtained. (1-1) The vibration or the compression reactive force is generated when the gas is compressed by the pistons 28. The vibration is transmitted to the front housing 12 through the compression reactive force transmission path. The vibration is absorbed by the vibration damping sheet 31, which is placed in the compression reactive force transmission path. Therefore, the vibration of the housing 10 is substantially suppressed. The vibration damping alloy absorbs the vibration by converting vibration energy into thermal energy that is generated by molecular friction inside the vibration damping alloy. The vibration damping alloy has a vibration absorption performance with low temperature-dependency and a high damping capacity. Fe—Cr—Al, which is one example of vibration damping alloy of ferromagnetic type according to the current invention, has approximately ten times as large damping capacity as Fe—Cr—Ni, which is one of common steel. The vibration damping sheet 31 that is made of Fe—Cr—Al is effective for reducing the vibration of the housing 10.

(1-2) The vibration damping sheet made of the vibration damping alloy according to the current invention substantially improves in its deterioration and has high durability against thermal and vibratory loads.

(1-3) The shape of the vibration damping alloy is freely changed according to a space in which the vibration damping sheet 31 is placed. Therefore, the degree of freedom in the shape of the vibration damping sheet 31 is relatively large.

(1-4) The vibration damping sheet 31 is bonded to both the front end wall 122 of the front housing 12 and the bearing race 301 of the thrust bearing 30. Since the vibration damping member does not substantially move or slide relative to the front end wall 122 of the front housing 12 and the bearing race 301 of the thrust bearing 30, the durability of the vibration damping member 31 is further improved.

(1-5) Vibration is generated at clearances between the lug plate 22 and the bearing race 302 of the thrust bearing 30, between the guide balls 241, 251 of each guide pin 24, 25 and the corresponding guide holes 222, 223 as well as between the circumferential surface of the drive shaft 18 and the shaft hole 231 of the swash plate 23. All the vibration generated at the clearances reaches the front housing 12 via the vibration damping sheet 31 placed between the front end wall 122 and the thrust bearing 30. Therefore, the position between the front housing 12 and the thrust bearing 30 is an appropriate position for the vibration damping sheet 31 to reduce the vibration of the housing 10.

(1-6) In a piston type compressor with a clutch, driving force is transmitted from an external drive source to a drive shaft via an electromagnetic clutch. The weight of the electric clutch, which is connected to a housing of the compressor, suppresses vibration of the housing. In the piston type compressor without a clutch, driving force is directly transmitted from an engine as an external drive source to the drive shaft 18. For this reason, the piston type compressor without a clutch vibrates more easily than the piston type compressor with the clutch. Therefore, the present preferred embodiment is suitable for the piston type compressor without a clutch since the vibration damping alloy of the present invention substantially reduces the vibration of the housing 10.

Figure 6:
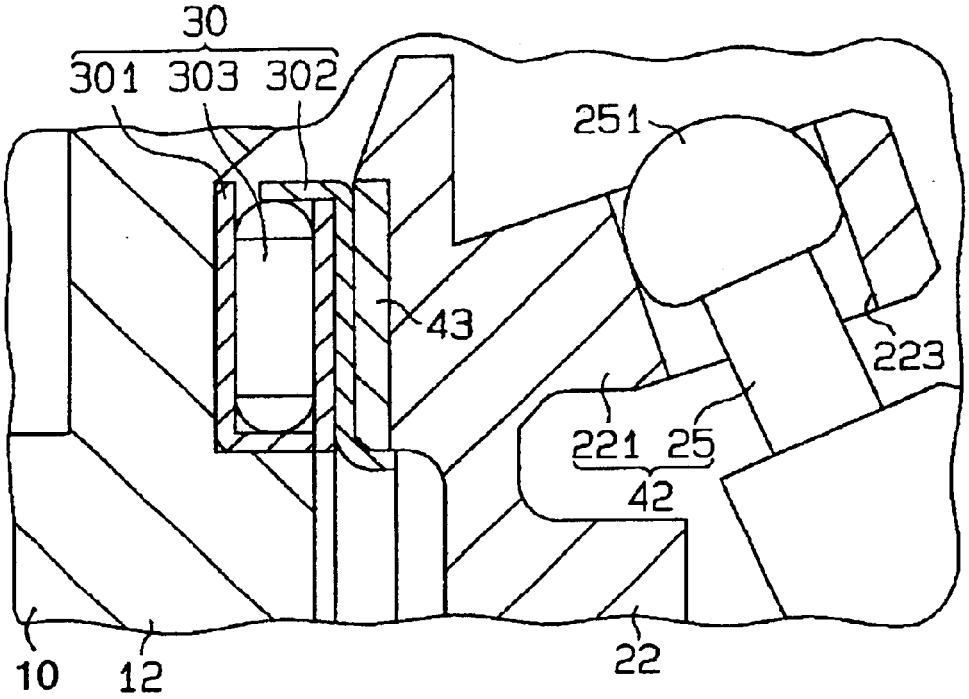
FIG. 6 is a partially enlarged cross-sectional view of a variable displacement compressor of a second preferred embodiment according to the present invention.

A second preferred embodiment will be described by referring to FIG. 6. The same reference numerals denote the substantially identical elements as those in the first preferred embodiment. A ring-shaped vibration damping sheet 43 made of the vibration damping alloy according to the current invention is interposed between the bearing race 302 of the thrust bearing 30 and the lug plate 22. The vibration damping sheet 43 absorbs the vibration that extends from the lug plate 22 to the thrust bearing 30. According to the second preferred embodiment, the same advantageous effects are obtained as mentioned in paragraph (1-1) to (1-4) and (1-6) according to the first preferred embodiment.

Figure 7:
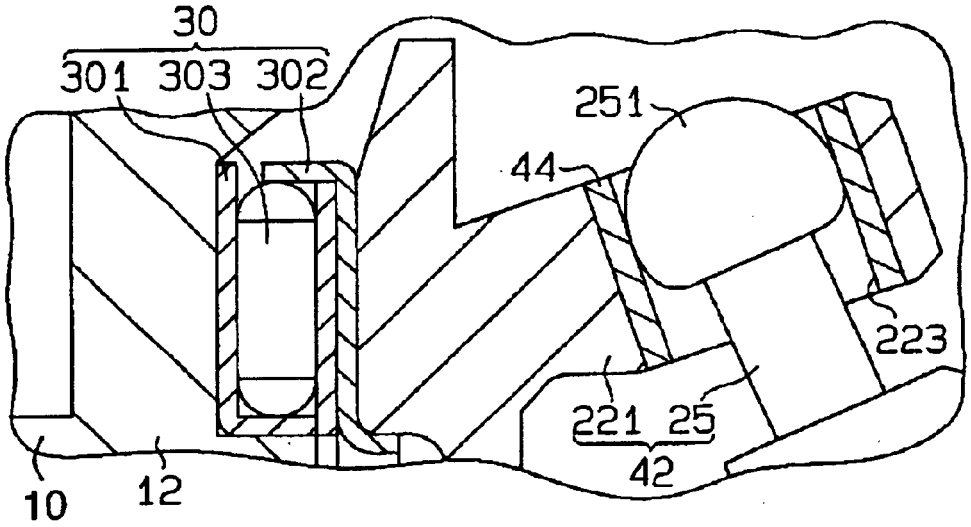
FIG. 7 is a partially enlarged cross-sectional view of a variable displacement compressor of a third preferred embodiment according to the present invention.
Figure 9:
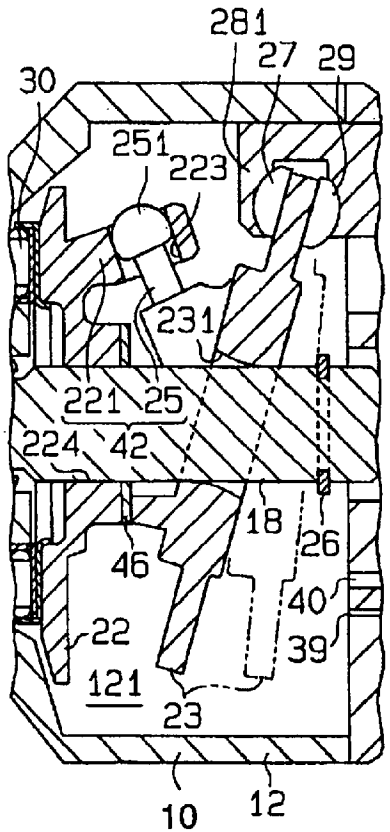
FIG. 9 is a partially enlarged cross-sectional view of a variable displacement compressor a fifth preferred embodiment of according to the present invention.
Figure 8:
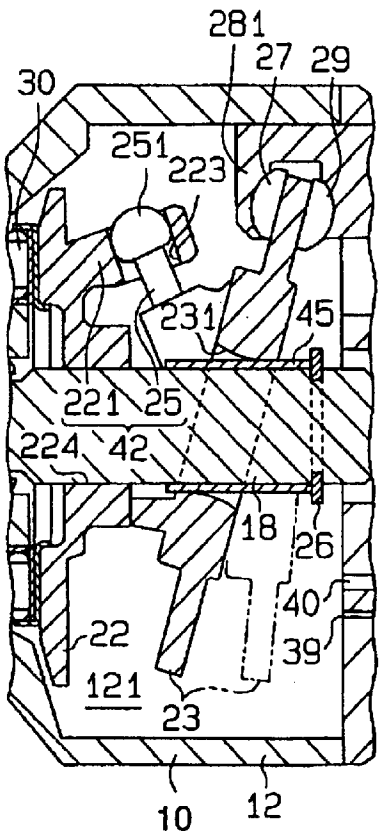
FIG. 8 is a partially enlarged cross-sectional view of a variable displacement compressor of a fourth preferred embodiment according to the present invention.

A third, fourth and fifth preferred embodiments will be respectively described by referring to FIGS. 7 through 9. The same reference numerals denote the substantially identical elements as those in the first preferred embodiment. In the third preferred embodiment, as shown in FIG. 7, vibration damping cylinders 44 made of the vibration damping alloy are respectively interposed between the support arm 221 along the surface of the guide hole 223 and the guide ball 251 and between the support arm 221 along the surface of the guide hole 222 and the guide ball 241. The guide hole 222 and the guide ball 241 are not shown in FIG. 7. In the third preferred embodiment, the vibration damping cylinders 44 are respectively press-fitted into the guide holes 222, 223. When the vibration damping cylinders 44 keep in slide contact with the guide balls 241, 251, respectively, the relative sliding speed between the vibration damping cylinder 44 and the guide balls 241, 251 is relatively small. Therefore, the durability of the vibration damping cylinders 44 does not substantially deteriorate by the slide contact of the vibration damping cylinders 44 and the guide ball 241, 251.

In the fourth preferred embodiment, as shown in FIG. 8, a vibration damping cylinder 45 made of the vibration damping alloy is interposed between the circumferential surface of the drive shaft 18 and the shaft hole 231 of the swash plate 23. In the fourth preferred embodiment, the vibration damping cylinder 45 is connected to the drive shaft 18. When the vibration damping cylinder 45 keeps in slide contact with the shaft hole 231 of the swash plate 23, the relative sliding speed between the vibration damping cylinder 45 and the shaft hole 231 of the swash plate 23 is relatively small. Therefore, the slide contact of the vibration damping cylinder 45 and the shaft hole 231 of the swash plate 23 does not substantially affect the durability of the vibration damping cylinder 45.

In the fifth preferred embodiment, as shown in FIG. 9, a vibration damping sheet 46 made of the vibration damping alloy is interposed between the swash plate 23 and the lug plate 22. In the fifth preferred embodiment, the vibration damping sheet 46 is secured to the lug plate 22 or the swash plate 23. When the inclination angle of the swash plate 23 is at the maximum, the compressor reactive force generated in compressing the gas by the pistons 28 is transmitted to the front housing 12 via the swash plate 23, the vibration damping sheet 46, the lug plate 22 and the thrust bearing 30. The vibration damping sheet 46 absorbs the vibration transmitted from the swash plate 23 to the lug plate 22 not via the guide pins 24, 25.

Figure 10:
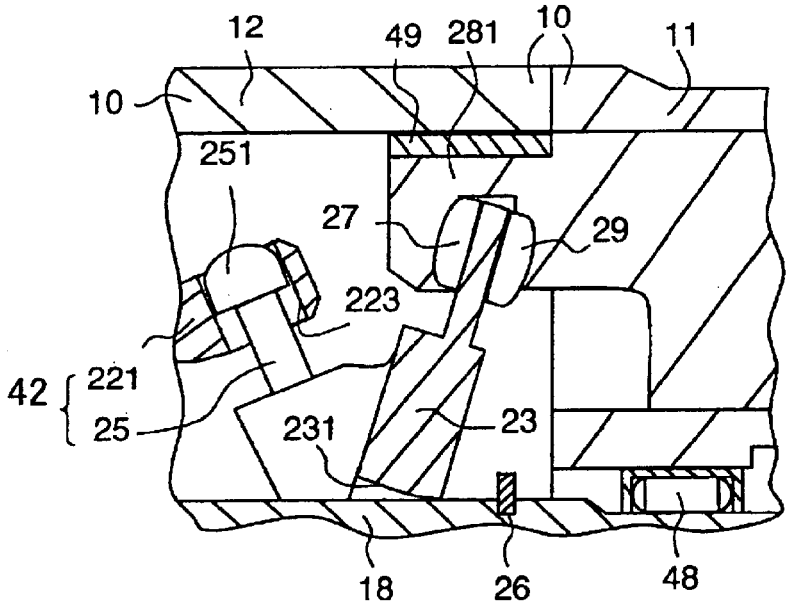
FIG. 10 is a partially enlarged cross-sectional view of a variable displacement compressor of a first alternative preferred embodiment according to the present invention.

According to the present invention, there are alternative preferred embodiments as follows. The same reference numerals denote the substantially identical elements as those in the first preferred embodiment. (1) As shown in FIG. 10, in a first alternative embodiment, a vibration damping member 49 made of the vibration damping alloy is interposed between the neck portion 281 of each piston 28 and the inner circumferential surface of the front housing 12. The neck portion 281 of each piston 28 is formed such that each piston 28 does not rotate in the associated cylinder bore 111. The compressor reactive force generated in compressing the gas by the pistons 28 is transmitted to the inner circumferential surface of the front housing 12 through the neck portion 281. The vibration damping members 49, which are interposed between the neck portion 281 of each piston 28 and the inner circumferential surface of the front housing 12, absorb vibration transmitted to the inner circumferential surface of the front housing 12 through the neck portion 281. Each of the vibration damping members 49 is secured to the neck portion 281 of each piston 28 and/or the inner circumferential surface of the front housing 12.

Figure 11:
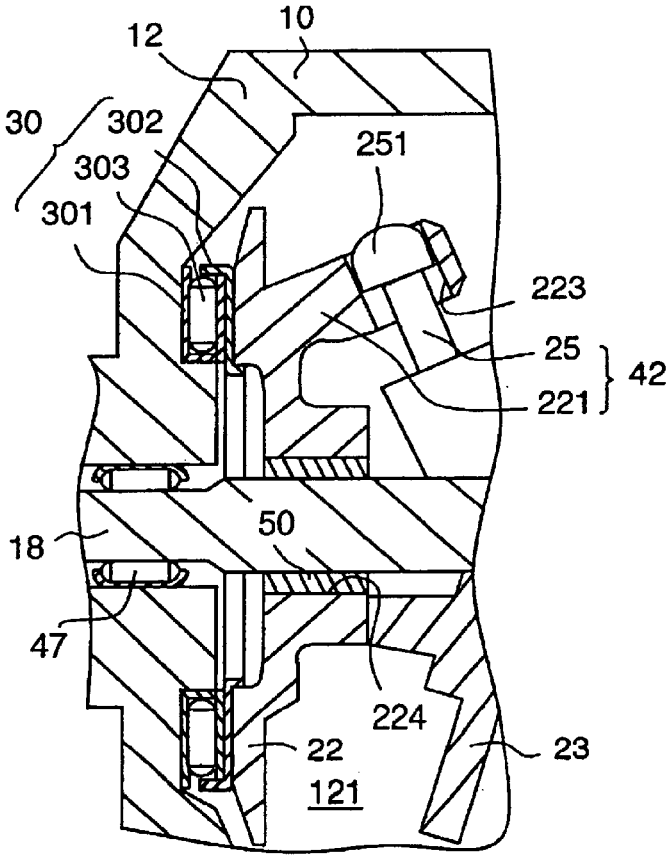
FIG. 11 is a partially enlarged cross-sectional view of a variable displacement compressor of a second alternative preferred embodiment according to the present invention.

(2) As shown in FIG. 11, in a second alternative embodiment, a cylindrical vibration damping member 50 made of the vibration damping alloy is interposed between the shaft hole 224 of the lug plate 22 and the circumferential surface of the drive shaft 18. In this case, the cylindrical vibration damping member 50 is secured to both the lug plate 22 and the drive shaft 18. The compression reactive force generated in compressing the gas by the pistons 28 is transmitted to the front housing 12 via the swash plate 23, the drive shaft 18, the lug plate 22 and the thrust bearing 30. The cylindrical vibration damping member 50 is interposed between the shaft hole 224 of the lug plate 22 and the circumferential surface of the drive shaft 18 and absorbs vibration transmitted from the drive shaft 18 to the lug plate 22.

Figure 12:
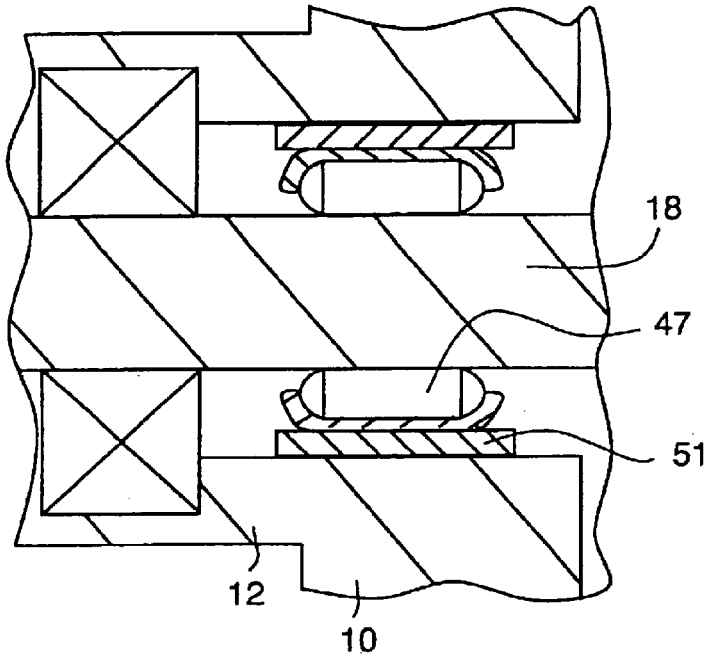
FIG. 12 is a partially enlarged cross-sectional view of a variable displacement compressor of a third alternative preferred embodiment according to the present invention.

(3) As shown in FIG. 12, in a third alternative embodiment, a cylindrical vibration damping member 51 made of the vibration damping alloy is interposed between the radial bearing 47 and the front housing 12. The compression reactive force generated in compressing the gas by the pistons 28 is transmitted to the front housing 12 via the swash plate 23, the drive shaft 18 and the radial bearing 47. The cylindrical vibration damping member 51 is interposed between the radial bearing 47 and the front housing 12 and absorbs vibration transmitted from the drive shaft 18 to the front housing 12 via the radial bearing 47.

Figure 13:
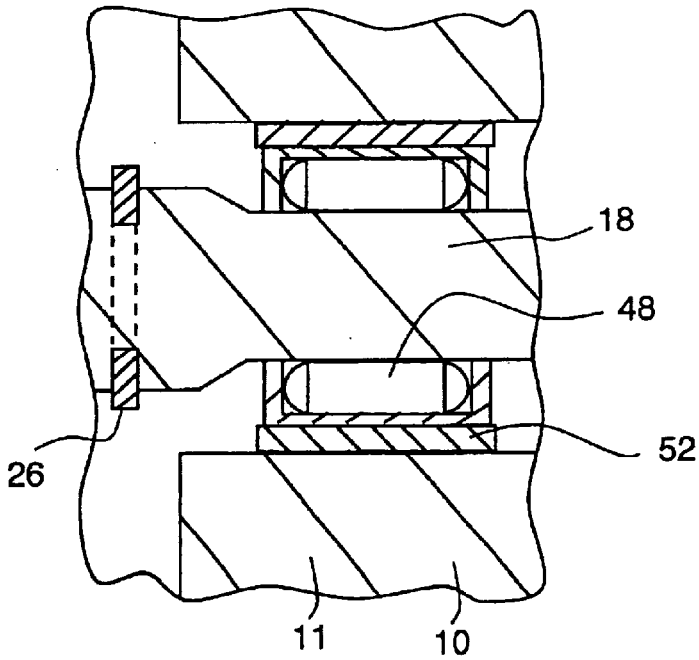
FIG. 13 is a partially enlarged cross-sectional view of a variable displacement compressor of a fourth alternative preferred embodiment according to the present invention.

(4) As shown in FIG. 13, in a fourth embodiment, a cylindrical vibration damping member 52 made of the vibration damping alloy is interposed between the radial bearing 48 and the cylinder block 11. The compression reactive force generated in compressing the gas by the pistons 28 is transmitted to the cylinder block 11 via the swash plate 23, the drive shaft 18 and the radial bearing 48. The cylindrical vibration damping member 52 is interposed between the radial bearing 48 and the cylinder block 11 and absorbs vibration transmitted from the drive shaft 18 to the cylinder block 11 via the radial bearing 48.

(5) In a fifth alternative embodiment, the vibration damping alloy includes a ferromagnetic type such as Fe—Cr—Al—Mn, Fe—Cr—Mo, Co—Ni and Fe—Cr.

(6) In a sixth alternative embodiment, the vibration damping alloy includes a compound type such as Al—Zn.

(7) In a seventh alternative embodiment, the vibration damping alloys includes a transition type such as Mn—Cu and Cu—Mn—Al.

(8) In an eighth alternative embodiment, the vibration damping alloys includes a twin type such as Cu—Zn—Al, Cu—Al—Ni and Ni—Ti.

(9) In a ninth alternative embodiment, the present invention is applied to a piston type fixed displacement compressor.

Any combination of the above described preferred embodiments and or the above described alternative embodiments is practiced according to the current invention. The present examples and embodiments are to be considered as illustrative and not restrictive, and the invention is not to be limited to the details given herein but may be modified within the scope of the appended claims.

What is claimed is:

1. A piston type compressor comprising:

a housing including a cylinder bore;

a drive shaft supported by the housing;

a lug plate secured to the drive shaft, the lug plate being rotationally supported by the housing;

a cam plate coupled to the lug plate, the cam plate being rotated by the rotation of the drive shaft;

a piston accommodated in the cylinder bore, the piston being coupled to the cam plate, the rotation of the cam plate being converted into the reciprocating movement of the piston, in accordance with the reciprocating movement of the piston, gas being introduced into the cylinder bore, the gas being compressed and discharged from the cylinder bore, compression reactive force being generated while the gas is being compressed by the piston, the compression reactive force being transmitted from the piston to the housing through a compression reactive force transmission path, the compression reactive force transmission path further including the drive shaft and the lug plate between the piston and the housing; and a vibration damping member made of a predetermined vibration damping alloy, the vibration damping member being placed between the lug plate and the drive shaft.

2. The piston type compressor according to claim 1, wherein the vibration damping alloy is one of ferromagnetic type including Fe—Cr—Al.

3. The piston type compressor according to claim 1, wherein the vibration damping alloy is a ferromagnetic type including Fe—Cr—Al—Mn, Fe—Cr—Mo, Co—Ni and Fe—Cr.

4. The piston type compressor according to claim 1, wherein the vibration damping alloy is of a compound type including Al—Zn.

5. The piston type compressor according to claim 1, wherein the vibration damping alloy is a transition type including Mn—Cu and Cu—Mn—Al.

6. The piston type compressor according to claim 1, wherein the vibration damping alloy is a twin type including Cu—Zn—Al, Cu—Al—Ni and Ni—Ti.

7. The piston type compressor according to claim 1, wherein the piston type compressor is a clutchless type compressor, in which an external drive source is coupled directly to the drive shaft to operate the compressor and which stops circulation of the gas in an external circuit in a state that the inclination angle of the cam plate is minimum while the drive shaft rotates.

8. A variable displacement compressor comprising:

a housing including a plurality of cylinder bores;

a drive shaft supported by the housing;

a lug plate secured to the drive shaft, the lug plate being supported in the housing by a thrust bearing;

a cam plate coupled to the lug plate by a hinge mechanism that includes a guide hole and a guide ball, the cam plate being slidably supported by the drive shaft and being at a certain angle within a predetermined range with respect to the drive shaft, the cam plate being rotated by the rotation of the drive shaft;

a plurality of pistons accommodated in the cylinder bores, each piston being coupled to the cam plate, the rotation of the cam plate being converted into the reciprocating movement of the pistons, in accordance with the reciprocating movement of the pistons, gas being introduced into the cylinder bores and being compressed and being discharged from the cylinder bores, compression reactive force being generated while the gas is being compressed by the pistons and being transmitted from the piston to the housing through a compression reactive force transmission path that includes a set of members including the pistons, the cam plate, the hinge mechanism, the lug plate, the drive shaft, the thrust bearing and the housing, the compression reactive force being received by the housing; and a vibration damping member made of a predetermined vibration damping alloy, the vibration damping alloy being placed between the lug plate and the drive shaft.

9. The variable displacement compressor according to claim 8, wherein said vibration damping member is placed on at least one of the members so as not to substantially move relative to the member which is in contact with the vibration damping member.

10. The variable displacement compressor according to claim 8, wherein the vibration damping alloy is one of ferromagnetic type including Fe—Cr—Al.

11. The variable displacement compressor according to claim 8, wherein the vibration damping alloy is a ferromagnetic type including Fe—Cr—Al—Mn, Fe—Cr—Mo, Co—Ni and Fe—Cr.

12. The variable displacement compressor according to claim 8, wherein the vibration damping alloy is a compound type including Al—Zn.

13. The variable displacement compressor according to claim 8, wherein the vibration damping alloy is a transition type including Mn—Cu and Cu—Mn—Al.

14. The variable displacement compressor according to claim 8, wherein the vibration damping alloy is a twin type including Cu—Zn—Al, Cu—Al—Ni and Ni—Ti.

15. The variable displacement compressor according to claim 8, wherein the variable displacement compressor is a clutchless type compressor, in which an external drive source is coupled directly to the drive shaft to operate the compressor and which stops circulation of the gas in an external circuit in a state that the inclination angle of the cam plate is minimum while the drive shaft rotates.

* * * * *